United States Patent [19]

Dötsch et al.

[11] Patent Number: 4,884,787

[45] Date of Patent: Dec. 5, 1989

[54] REFRACTORY, CERAMIC, SHAPED MEMBER

[75] Inventors: Lorenz Dötsch, Vallendar; Karl-Heinz Höfer, Urmitz; Jean-Louis Retrayt, Neuwied; Bernd Kull, Bad Breisig, all of Fed. Rep. of Germany

[73] Assignee: Radex Deutschland Aktiengesellschaft für feuerfeste Erzeugnisse, Urmitz, Fed. Rep. of Germany

[21] Appl. No.: 197,849

[22] Filed: May 24, 1988

[30] Foreign Application Priority Data

May 27, 1987 [DE] Fed. Rep. of Germany ..... 3717840

[51] Int. Cl.[4] ..... C21C 5/48

[52] U.S. Cl. ..... 266/270; 266/218

[58] Field of Search ..... 266/218, 265, 266, 267, 266/268, 270

[56] References Cited

U.S. PATENT DOCUMENTS

| | | | |
|---|---|---|---|
| 3,819,165 | 6/1974 | Courard et al. | 266/268 |
| 4,023,781 | 5/1977 | Fritz et al. | 266/268 |
| 4,036,481 | 7/1977 | Pearce et al. | 266/268 |
| 4,423,858 | 1/1984 | Ostlund | 266/270 |
| 4,709,905 | 12/1987 | Winkelmann et al. | 266/270 |
| 4,721,287 | 1/1988 | Winkelman | 266/270 |

FOREIGN PATENT DOCUMENTS

| | | | |
|---|---|---|---|
| 2503672 | 9/1975 | Fed. Rep. of Germany | 266/270 |
| 8622299 | 11/1986 | Fed. Rep. of Germany . | |
| 3520207 | 12/1986 | Fed. Rep. of Germany . | |
| 3520783 | 12/1986 | Fed. Rep. of Germany . | |
| 8626930 | 1/1987 | Fed. Rep. of Germany . | |
| 3527793 | 2/1987 | Fed. Rep. of Germany . | |
| 3531533 | 2/1987 | Fed. Rep. of Germany . | |
| 3531534 | 2/1987 | Fed. Rep. of Germany . | |
| 195910 | 8/1986 | Japan | 266/270 |

*Primary Examiner*—Robert McDowell

*Attorney, Agent, or Firm*—Becker & Becker, Inc.

[57] ABSTRACT

A refractory, ceramic, shaped member or nozzle. The shaped member is provided with a passage, preferably in the center. To prevent molten material that might penetrate the passage from penetrating therethrough and solidifying at such a later point, a cooling device may be provided in the passage.

12 Claims, 2 Drawing Sheets

REFRACTORY, CERAMIC, SHAPED MEMBER

BACKGROUND OF THE INVENTION

The present invention relates to a refractory, ceramic, shaped member for supplying gas and/or solids to molten metal in a metallurgical vessel. Shaped members of this type are generally referred to as "nozzles".

Nozzles are preferably inserted in the wall or base of a metallurgical smelting vessel (for example a converter or ladle), generally via a nozzle brick, and serve for the injection of scavenging gases, especially inert scavenging gases such as argon, in order to treat the smelt for optimizing quality.

Nozzles of this general type are known, for example, from German Offenlegungsschriften Nos. 35 31 533, Wertz dated Feb. 19, 1987 35 27 793, Bender et al dated Feb. 12, 1987 35 31 534, Wertz dated Feb. 19, 1987 and 35 20 783 LaBate dated Dec. 11, 1986. In addition, German Offenlegungscchrift No. 35 20 207 Winkelmann et al dated Dec. 11, 1986 discloses a nozzle that is intended for injecting gases or solids into a ladle containing molten metal. The single FIGURE of this last-mentioned reference, which deals exclusively with the mounting of the nozzle in the nozzle brick, shows a nozzle having a large, central passage through which gases or solids are to be injected. Such a nozzle with an extremely large passage cannot be used in practice, because with such a large passage, molten metal would readily enter the nozzle and would destroy the device.

However, there is a pressing need for also being able to inject solids into molten metal, especially for the purpose of desulfurizing the metal. Such solids include fine lime or mixtures of fine lime and soda, as well as calcium carbide ($CaC_2$) or calcium cyanamide ($CaCN_2$).

Solids, no matter how fine they are, cannot be injected via heretofore known gas nozzles, as they are summarized, for example, in "Radex-Rundschau, 1987, 288", because the fine porosity of such gas nozzles would rapidly lead to a blockage, and hence to a non-functionality, of the device. Furthermore, there would be the great danger that the molten metal would infiltrate as soon as the gas pressure was somewhat reduced.

Therefore, for the most part at present so-called injection or immersion lances are use for injecting solids; such lances are disclosed, for example, in German Gebrauchsmustern 86 22 299 dated Nov. 13, 1986 or 86 26 930 dated Jan. 8, 1987. Not only inert gases but also additives of the aforementioned type are introduced into the molten metal via such injection lances. For this purpose, the injection head and the major part of the casing of the injection lance are immersed in the molten metal. The gas and/or solid material is introduced into the molten metal via the so-called lance core, which is generally a steel pipe that opens out in the injection head via appropriate outlets.

That part of the injection lance that is immersed in the molten metal is subjected to considerable thermal and mechanical stresses, with repeated reference being made to this situation in the aforementioned German Gebrauchsmustern. However, if, for example, cracks or fissures reach the core of the lance, the injection lance is no longer usable and must be replaced. The worn out lance cannot be reused, despite the fact that a considerable portion of the casing would still be functional.

Numerous experiments in the past have therefore dealt with the mechanical stabilization of such injection lances.

A particular problem with this is that when the lance is emersed in the molten metal bath, and during the injection process, considerable oscillating movements, and hence high pressing forces, occur due to the displacement of the liquid; these forces must be absorbed without damage occurring to the lance, and in particular to the refractory casing. However, in practice this problem cannot be taken care of with an injection lance that is freely immersed in molten metal via a so-called lance stand.

It is therefore an object of the present invention to provide a possibility for the simple and reliable supply of gas and/or solid material to the molten metal of a metallurgical vessel in such a way that the mechanical problems encountered with injection lances do not occur, but at the same time, without the danger of blockages or of a break-through of the molten metal, solids can be readily introduced into the molten metal. It is furthermore an object of the present invention to be able to introduce, preferably via a single device, both gases as well as solids, even in combination if necessary.

BRIEF DESCRIPTION OF THE DRAWINGS

This object, and other objects and advantages of the present invention, will appear more clearly from the following specification in conjunction with the accompanying schematic drawings.

SUMMARY OF THE INVENTION

Figure 1:
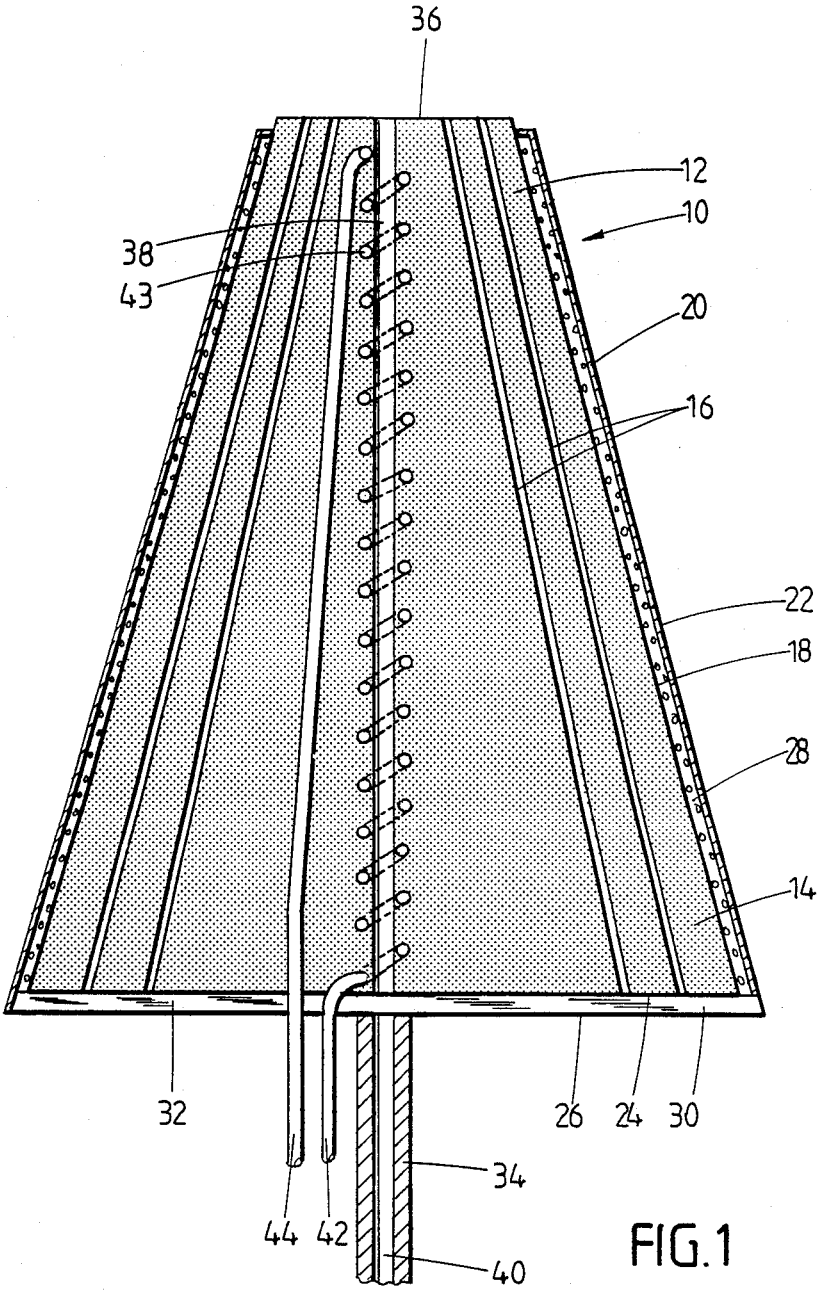
FIG. 1 is a longitudinal, cross-sectional view through an embodiment of the inventive refractory shaped member having a cooling arrangement.
Figure 2:
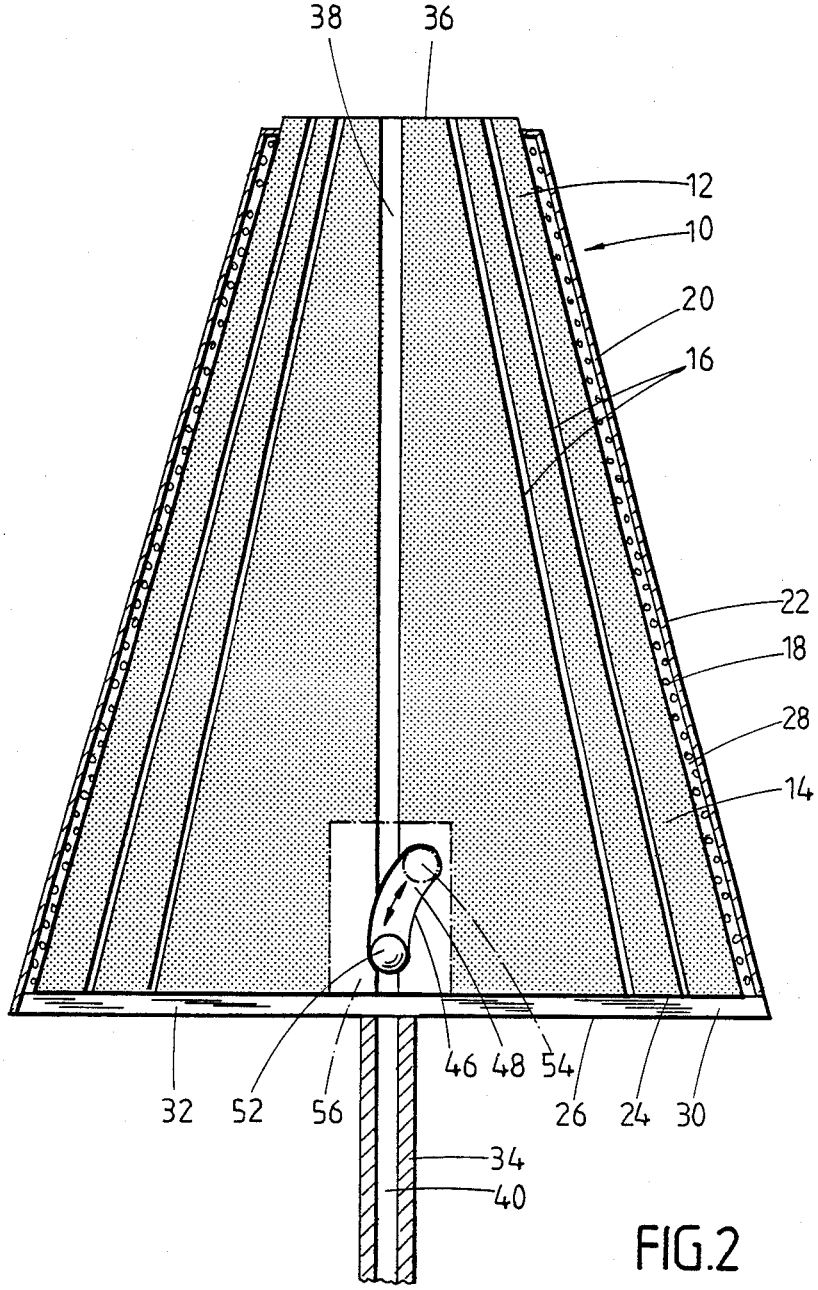
FIG. 2 is a longitudinal, cross-sectional view through an embodiment of the inventive refractory shaped member having a check valve.

The present invention is based on the understanding that a gas nozzle of conventional construction can be used as the basis for an appropriate device. Starting from this premise, the shaped member of the present invention has a passage that extends from an end that faces the molten metal to an opposite end, where the passage can be connected to a supply pipe for gas and/or solid, with the passage being large enough to permit solid material to be conveyed therethrough; means are associated with the passage to prevent molten metal from penetrating through the passage.

In this connection, the last-mentioned features are of particular significance. This is because the invention has recognized that, for example, the channels of gas nozzles having "directed porosity" (Radex-Rundschau, loc. cit.) are just as unsuitable for conveying solids as are the pores in a gas nozzle having "undirected porosity". Rather, the passage must be larger, with an average diameter of, for example, 2 to 10 mm, and preferably 4 to 6 mm. However, with an open cross section of this type, the danger that molten metal can enter is, of course, greater; this is reliably prevented by inventively disposing an additional device in the passage.

The present invention proposes various alternative constructions for such a device.

One possibility consists of assuring that the passage can be cooled by a cooling device at least at that end that faces the metal-smelting vessel.

This ensures that in the event that molten metal enters the passage, for example where accidental pressure loss occurs in the passage, the molten metal is immediately solidified by the cooling action of the cooling device, and does not penetrate further into the passage in the direction toward that end thereof that is adjacent to the connection.

The cooling device can be constructed in various ways. Pursuant to one advantageous embodiment it is proposed that the cooling device be formed from a cooling pipe that is disposed directly adjacent the passage and through which liquid or gas can flow.

This cooling pipe can be guided about the passage in, for example, a helical manner, thus making possible an intensive cooling that, during normal operation, i.e. when an inert gas and/or a preferably pulverous solid material is injected through the passage, does not disrupt the operation, yet on the other hand if molten metal enters the passage, immediately causes the latter to solidify.

The cooling pipe can be arranged in such a way that it forms a closed circuit or loop. In an alternative embodiment, the cooling pipe opens out in that surface of the shaped member that faces the molten metal of the metallurgical vessel and is disposed remote from that end of the shaped member that is adjacent to the connection. Thus, the cooling gas conveyed through the cooling pipe is injected into the molten metal. This embodiment can be utilized, for example, for conveying through the cooling pipe the inert gas for scavenging, while the pulverous solid materials themselves are guided through the passage, if necessary together with further scavenging gas.

The cooling pipe is preferably embodied as a copper pipe that, due to its excellent thermal conductivity, further increases the desired cooling effect.

In addition, the cooling pipe can simultaneously be used for indicating the residual intensity, with examples of residual intensity indicators being described, for example, in the aforementioned Radex-Rundschau. In this case, the electrical conductivity of the copper material of the pipe can be used for closing or interrupting an electrical circuit, for example when molten metal penetrates, and at the same time can be used for actuating an appropriate signal device.

Pursuant to a completely different device for preventing molten metal from penetrating into the passage, at least one valve is disposed in the passage. When a predetermined flow of gas and/or solid material is achieved, the valve opens the passage; otherwise, the valve closes the passage.

Valves of this type, generally known as check valves or pressure-loss valves, are known to one skilled in the art in conjunction with the conveyance of fluids. In this connection, the stream of liquid is possible only against the force of a spring or a weight. The heretofore known devices for preventing return flow are incorporated in an inventive shaped member in order to prevent or reduce as far as possible the penetration of molten metal into the passage.

Pursuant to one concrete embodiment, the check valve is provided with a closing member that seals off the passage in the initial position, for example without gases and/or solids being passed through. The closing member can be moved away from it sealing position when a certain stream of gas and/or solids is applied to the pressure member.

It is to be understood that the closing member must be larger than the cross section of the passage in order to ensure a reliable seal.

In order to be able to dispose the closing member in the shaped member, i.e. in the valve, further alternatives are proposed pursuant to the present invention.

One possibility, during production of the shaped member, is to incorporate along the path of the passage a member that comprises a combustible material, for example a synthetic foam material, with the closing member being contained in this material. This combustible member has the shape of the chamber of the check valve, which chamber is to be formed later.

After the member is burned, there remains only the closing member as such, which preferably comprises a high-grade refractory ceramic material, such as zirconium dioxide ($ZrO_2$) or titanium dioxide ($TiO_2$).

Pursuant to another alternative, the part that accommodates the check valve can be produced separately. In so doing, this part can, in turn, comprise two parts that together form the chamber of the check valve and are provided with appropriate connection openings for the passage. The "block" that is produced separately in this manner is then inserted into the nozzle, preferably at that end adjacent to the connection, and is fixed therein, for example with mortar.

In order to achieve a particularly reliable seal, it is proposed pursuant to a further advantageous embodiment of the present invention to construct the closing member as a ball, so that independent of the respective alignment, a reliable abutment against the passage is always assured in the closing position.

In order to further optimize the contact region between the closing member and the passage, for example when the valve chamber is embodied as a separate component, the latter can also be made of a high-grade refractory ceramic material of the aforementioned type, which is very resistant to abrasion.

A reliable seal for example in the event that the injection process is interrupted, also ensures that a closed chamber results above the valve; the column of gas that builds up in this closed chamber makes it difficult for molten metal to penetrate.

Should molten metal nevertheless penetrate, the valve safety ensures that the flow of metal is stopped in the region of the nozzle, and the molten metal is subsequently solidified.

Due to the additional arrangement of the aforementioned cooling device, it is also possible to ensure that molten metal can penetrate only into the uppermost regions of the passage, where the molten metal immediately solidifies. This has the advantage that a nozzle of this type can be reused. Instead of having to change the nozzle, it is necessary only to drill out the upper, solidified region, whereupon the nozzle is available for further use.

The advantages of a shaped member of the present invention are obvious. Gas nozzles of known construction need to be altered only slightly, namely by providing a passage that has means for preventing molten metal from penetrating. As a result, neither the shape nor the function of conventional gas nozzles is changed. It is obvious that the additional devices or means can be provided not only in gap scavengers, but also in gas nozzles having undirected or directed porosity.

Without changing external dimensions a shaped member of the present invention additionally permits solids to be injected through a preferably central passage of appropriate size.

As with a conventional gas nozzle, the inventive nozzle is inserted, for example, in a nozzle brick (if necessary via a nozzle brick sheath), and is rigidly disposed therein. Problems relating to mechanical load, such as occur with injection lances, as previously described, are eliminated. In this respect, the device of the present invention is no longer subject to mechanical loads, thus significantly increasing its service life. Furthermore, complicated measures for setting up a lance stand can be dispensed with. The injection of gases and solids, especially near the base, makes the treatment of the smelt uniform relative to methods using injection lances. Above all, an inventive shaped member is far more economical than the known lance arrangement.

The shaped member could also be combined with means for protecting against a break-through, as described, for example, in the aforementioned Radex-Rundschau.

Pursuant to a further inventive embodiment, the device for preventing molten metal from penetrating into the passage can also be formed by a siphon-like or trap-like guide mechanism or the like of the passage itself. Due to the "elbow" that is formed in this manner, when the supply of gas and/or solids is reduced or interrupted, a type of pressure cushion is formed in the end adjacent the connection, whereas in the upper section that faces the molten metal in the vessel, the flow of molten metal that might penetrate is stopped and can thus solidify even quicker, especially if a cooling device is provided. The jog or point of discontinuity in the passage, generally referred to as a trap, can be constructed in various ways, for example as an S-shape.

When solid additives are injected into a molten metal, the procedure is as follows:

(a) First of all, the inert gas pipe is connected, whereupon gas is forced through the passage and/or the cooling device and/or the porous, refractory material of the nozzle. Due to the flow of inert gas through the passage, the check valve is moved away, so that the free cross section of the passage is made available;

(b) A specific quantity of the pulverous or granular additive is subsequently injected into and through the passage, possibly in combination with inert gas;

(c) During operation, the quantities of the gas and/or solid material can be regulated by appropriate regulation/control of the supply pipes;

(d) After the supply of solid material is interrupted, it would be possible to carry out a scavenging with pure inert gas, until (e) finally the supply of inert gas is also discontinued. At this instant, the check valve again comes back into operation, with the closing member sealing-off the passage, so that any molten metal that might penetrate into the passage can penetrate at most as far as the check valve, where it would solidify; however, the molten metal generally solidifies much earlier due to the presence of the cooling pipe.

Further specific features of the present invention will be described in detail subsequently.

DESCRIPTION OF PREFERRED EMBODIMENTS

Referring now to the drawing in detail, a nozzle is designated by the reference numeral 10 and has the following features:

The nozzle comprises a conventional, refractory material that is chosen, for example, in conformity with the type of ladle, the tapping temperature, the ladle treatment, the scavenging time, etc. In this embodiment, the refractory material contains 97% by weight $Al_2O_3$.

The nozzle has the shape of a truncated cone, with its upper, narrower end 12 faces the molten metal in the smelting vessel, while the lower, wider end 14 forms the end adjacent the connection.

The nozzle 10 is provided with a plurality of channels 16 that extend essentially parallel to the peripheral surface 18, and have a small diameter (the maximum diameter is approximately 1 mm). The dense material between the channels 16 is essentially of so-called corundum quality.

A sheet metal sheathing 20 surrounds a sheet metal jacket 22 that extends around the peripheral surface 18 of the nozzle 10; the sheathing 20 also surrounds a circular base 26 that covers the lower end face of the nozzle 10 and that has an outer periphery that is welded to the sheet metal jacket 22 in a gastight manner. The ceramic shaped member is disposed in the sheet metal jacket 22 via a layer of mortar 28 in such a way that a space 30 remains between the lower end face 24 and the base 26. This is achieved by two spacers 32 that extend crosswise with respect to one another (in the drawing that spacer 32 that extends parallel to the plane of the drawing can be seen). Extending downwardly from the center of the base 26 is a connecting pipe 34 that is connected in a gastight manner and through which an inert gas, such as argon, can be injected into the pressure chamber 30 and from there through the channels 16. The stream of gas passes via the lower channel openings, which are open toward the end face, through the channels 16 to the opposite ends 36, and from there into the non-illustrated molten metal. The gas connection for the pipe 34 is effected in a known manner. Similarly, it is to be understood that the nozzle 10 may be disposed in a suitable manner in the base or the wall of the metallurgical smelting vessel, for example in a nozzle brick or via a nozzle brick sleeve.

Arranged concentrically to the central longitudinal axis of the nozzle 10, and disposed in the latter, is a passage 38 that can either be drilled-out or can be formed by a metal tube or a dense refractory tube.

The passage 38 extends from the upper end face 36 to the lower end face 24, and from there continues in a connecting pipe 40 the first part of which extends concentrically relative to the connecting pipe 34 and then passes through the latter in a gastight manner.

Extending in a helical manner about the passage 38 is a copper pipe 43 that forms a closed-loop loop system with a feed pipe 42 and a discharge pipe 44. It is obvious that cooling air introduced through the feed pipe 42 flows in a helical manner about the passage 38, due to the positive guidance, as far as the upper end 36 of the shaped member, and from there back to the discharge pipe 44, thereby producing a high cooling effect due to the fact that the pipe 43 closely surrounds the passage 38.

A valve 46 is disposed in the passage 38 somewhat above the lower end face 24. This valve 46 comprises a chamber 48 that widens out on both sides of the passage 38. In the illustrated cross-sectional view, this chamber has an approximately kidney shape that extends upwardly, in a laterally offset manner, from a section disposed directly above the inlet opening of the passage 38 into the refractory ceramic material.

Disposed within the chamber 48 is a ball 52 that in the illustrated embodiment rests directly on the inlet opening of the passage 38, where the ball 52 seals this opening.

The chamber 48 is embodied in such a way that upon the application of a certain gas pressure, the ball 52 is pushed away from its sealing position at the inlet opening of the passage 38, and is guided along a positive guidance, indicated by the arrows, out of engagement with the passage 38 and into the position 54 indicated by dashed lines in the drawing; as a result, the path of the passage 38 is completely clear.

The chamber 48 with the ball 52 can, for example, be introduced as follows:

During the production of the refractory shaped material, an appropriately shaped part of combustible material is formed therein, with the ball 52 being located in this part. At the appropriate temperature, the material burns away and exposes the area of the chamber 48 with the ball 52.

However, it is also possible to construct the dot-dash region about the valve 46 as a separate component, which could, in turn, be comprised of two halves. The component 56 is inserted in the appropriately bored-out or recessed matrix material of the shaped member 10, in which it can be fixed, for example, by mortar. The shaped member operates as follows:

First of all, a normal gas-scavenging operation can be initiated by injecting an inert gas through the supply pipe 34 into the pressure chamber 30, and from there through the channels 16 into the molten metal.

By connecting a gas reservoir, which is similarly not shown, argon, for example, is then injected through the supply pipe 40 into the lower part of the passage 38, with the gas stream, when it reaches the ball 52, guiding the latter out of the closing position into the upper position 54 that is illustrated by dashed lines; in so doing, the cross section of the passage 38 is opened. The gas then flows further through the passage 38 into the molten metal. At the same time, or preferably with a slight time delay, a pulverous or granular additive, such as lime or the like, is injected into the supply line 40 and is guided in the same manner through the passage 38 and into the molten material.

If the solid or gas that is guided through the passage or channel 38 falls below a certain flow speed, the ball 52 drops back into its closing position at the inlet opening of the passage 38, thus sealing the bottom of the passage 38.

Any molten metal that might possibly enter the passage 38 is therefore stopped at least at this location, where the material would then solidify.

Due to the arrangement of the cooling pipe 43 about the passage 38, it can actually be assured that any molten metal that might possibly enter the passage 38 would be solidified much earlier, namely in the region of the upper end face 36, thereby preventing any further molten material from entering the passage 38.

In addition, the copper pipe 43 serves a safety function. In particular, if the upper region 12 of the nozzle 10 becomes eroded to a certain depth, the molten material reaches the copper pipe 43 and melts the latter. At the same time, the pressure in the pipes 42, 44 drops, which can be registered by appropriate indicators. It is then time to change the nozzle.

However, it would also be possible to use the metallic conductivity of the copper material for the connection of appropriate residual intensity indicators, as described, for example, in the German Offenlegungsschriften Nos. 34 24 466 or 35 03 221.

The present invention is, of course, in no way restricted to the specific disclosure of the specification and drawing, but also encompasses any modifications within the scope of the appended claims.

What we claim is:

1. A refractory, ceramic, shaped member for supplying gas and/or solid material to molten metal in a metallurgical vessel; the shaped member having a first end facing said molten metal, and a second end remote from said first end; said shaped member being provided with a passage extending from said second end, where it can be connected to a supply pipe for said gas and/or solid material, to said first end, where said passage opens out, with said passage being large enough to permit solid material to be conveyed therethrough; and means associated with said passage being provided to prevent molten metal from penetrating through said passage, said means being closed toward the molten metal and including a cooling device which comprises a cooling pipe that is disposed directly adjacent to said passage, and through which a cooling fluid can flow via a feed pipe, the cooling pipe and a discharge pipe forming a closed-loop system for cooling at least that portion of said passage disposed in the vicinity of said first end of said shaped member.

2. A shaped member according to claim 1, in which said cooling pipe extends about said passage in a helical manner.

3. A shaped member according to claim 2, in which said cooling pipe is a copper pipe.

4. A shaped member according to claim 1, in which said passage has a diameter of between 2 and 10 mm.

5. A shaped member according to claim 4, in which said diameter of said passage is between 4 and 6 mm.

6. A shaped member according to claim 1, in which said passage is in the form of a siphon.

7. A refractory, ceramic, shaped member for supplying gas and/or solid material to molten metal in a metallurgical vessel; the shaped member having a first end facing said molten metal, and a second end remote from said first end; said shaped member being provided with a passage extending from said second end, where it can be connected to a supply pipe for said gas and/or solid material, to said first end, where said passage opens out, with said passage being large enough to permit solid material to be conveyed therethrough; and means associated with said passage being provided closed for preventing molten metal from penetrating through said passage, said means comprising at least one valve means that is disposed in said passage and opens same when a certain flow of gas and/or solid material is reached.

8. A shaped member according to claim 7, in which said at least one valve means includes a closing member for sealing-off said passage in an initial position where flow of gas and/or solid material, if any, is below said certain flow; said closing member is arranged to move out of its sealing position and open said passage when the latter receives gas and/or solid material at said certain flow.

9. A shaped member according to claim 8, in which said valve means includes a movement path, with said closing member being a ball that is guided along said movement path, out of said passage, when said certain flow of gas and/or solid material is reached.

10. A shaped member according to claim 8, in which said valve means is a separate component disposed in said shaped member.

11. A shaped member according to claim 8, in which at least one of said closing member and said valve means is made of a refractory, ceramic material that is highly resistant to abrasion.

12. A shaped member according to claim 11, in which said ceramic material is selected from the group consisting of $ZrO_2$ and $TiO_2$.

* * * * *